US010759639B2

(12) United States Patent
Nadagouda

(10) Patent No.: US 10,759,639 B2
(45) Date of Patent: Sep. 1, 2020

(54) LINEAR WINCH

(71) Applicant: Alfred Cheyne Engineering Limited, Aberdeenshire (GB)

(72) Inventor: Nishant Nadagouda, Aberdeenshire (GB)

(73) Assignee: Alfred Cheyne Engineering Limited, Aberdeenshire (GB)

( * ) Notice: Subject to any disclaimer, the term of this patent is extended or adjusted under 35 U.S.C. 154(b) by 0 days.

(21) Appl. No.: 15/580,534

(22) PCT Filed: Jun. 17, 2016

(86) PCT No.: PCT/GB2016/051809

§ 371 (c)(1),
(2) Date: Dec. 7, 2017

(87) PCT Pub. No.: WO2016/207612

PCT Pub. Date: Dec. 29, 2016

(65) Prior Publication Data

US 2018/0179033 A1 Jun. 28, 2018

(30) Foreign Application Priority Data

Jun. 23, 2015 (GB) ..... 1511015.8

(51) Int. Cl.
*B66D 3/00* (2006.01)
*B65H 51/18* (2006.01)
*B63B 35/04* (2006.01)

(52) U.S. Cl.
CPC ..... *B66D 3/006* (2013.01); *B63B 35/04* (2013.01); *B65H 51/18* (2013.01)

(58) Field of Classification Search
CPC ..... B65H 51/18; B66D 3/006
See application file for complete search history.

(56) References Cited

U.S. PATENT DOCUMENTS 3,361,035 A 1/1968 Hunter Rountree
4,427,180 A * 1/1984 Brieuc ..... F16G 11/048 254/106

(Continued)

FOREIGN PATENT DOCUMENTS

CN 202729684 U 2/2013

OTHER PUBLICATIONS

Ley, "A member of the Murphy Group of Companies", May 10, 2015, available at http://www.iploca.com/platform/content/element/24293/LandMarine-LandfallsandoutfallsIPLOCA10thMay2015.pdf (Year: 2015).*

(Continued)

*Primary Examiner* — Michael McCullough
(74) *Attorney, Agent, or Firm* — Workman Nydegger

(57) ABSTRACT

The invention provides a linear winch assembly (10), gripper assembly (14, 16) and a method of use. The linear winch assembly comprises a first gripper assembly comprising a first gripper block (28*b*) operable to grip a cable and a second gripper assembly comprising a second gripper block operable to grip a cable (17). The winch assembly comprises a first mechanism (30, 31, 32) operable to move at least part of the first gripper block out of the pathway of a cable connector to allow the connector (19) to pass through the first gripper assembly. The winch assembly also comprises a second mechanism operable to move at least part of the second gripper block out of the pathway of a cable connector to allow the connector to pass through the second gripper assembly. It also comprises a pivotable lid (28*a*).

23 Claims, 11 Drawing Sheets

(56) References Cited

U.S. PATENT DOCUMENTS

| | | | | | |
|---|---|---|---|---|---|
| 4,569,507 | A | * | 2/1986 | Robert | B66D 3/006 24/136 R |
| 4,874,152 | A | * | 10/1989 | Roberts | B66D 3/006 254/264 |
| 5,544,608 | A | | 8/1996 | Horton, III | |
| 5,692,859 | A | * | 12/1997 | Dickson | B65H 51/14 405/158 |

OTHER PUBLICATIONS

International Search Report and Written Opinion for international application No. PCT/GB2016/051809 dated Oct. 20, 2016.
Tim Ley: "A member of the Murphy Group of Companies", May 10, 2015 (May 10, 2015), XP055308107.

* cited by examiner

LINEAR WINCH

CROSS-REFERENCE TO RELATED APPLICATIONS

The present invention is a 35 U.S.C. § 371 U.S. National Stage of International Application No. PCT/GB2016/051809, filed on Jun. 17, 2016, which claims priority to Great Britain Patent Application No. 1511015.8, filed Jun. 23, 2015, the entire content of each of which is incorporated herein by reference.

The present invention relates to linear winch assemblies which use grip assemblies to clamp and pull a winch cable, and in particular to an improved gripper assembly for use in such linear winch assemblies. Aspects of the invention include a linear winch assembly including such a gripper assembly and a method of use.

BACKGROUND TO THE INVENTION

During the installation and maintenance of load bearing cables such as in marine applications, it is necessary to lower and/or raise cables into position. Winch assemblies must be capable of withstanding heavy loads from the weight of the cables and loads attached to the cables.

In applications which use relatively short cable lengths with small loads conventional reel winches may be used. However, for longer cable lengths with heavy loads reel winches are not suitable as they require large drums to accommodate the longer cable and may result in unacceptable loading applied to the drum. Furthermore, the reel winch may prevent the tensioning and releasing of the cable from being accurately controlled.

It is known to use linear winches in combination with a reel winch. The linear winch is used to pull the cable and maintain the tension on the cable while the reel winch reels or unreels the cable on a reel drum.

Linear winches usually comprise two gripper assemblies which clamp and pull the cable in a coordinated operation. As a first gripper assembly grips and pulls the cable a second gripper assembly allows the cable to pass freely. As the second gripper assembly grips and pulls the cable the first gripper assembly releases the cable and slides over the cable to return to its initial position. The successive holding and releasing steps of the two gripper assemblies allows the tension of the cable to be maintained as it is pulled.

U.S. Pat. No. 4,569,507 describes a traction block for a linear winch comprising an elongate frame and two clamping blocks which are mounted between lateral flanges on the frame so that a relative longitudinal movement between each movable clamping block and the adjacent flange of the frame causes a transverse movement of the respective movable clamping block. The traction block also comprises a cover plate which is detachable fixed to the traction block.

A disadvantage of this system is that the winch must be taken offline, the winch assembly dismantled and components of the winch to be removed in order to lift the cable connector clear of the winch assembly. This is time consuming and dangerous operation especially when the cable is under tension.

SUMMARY OF THE INVENTION

It is an object of at least one aspect of the present invention to obviate or at least mitigate the foregoing disadvantages of prior art linear winches.

It is another object of an aspect of the present invention to provide a linear winch assembly with improved productivity and/or efficiency which is capable of reliably performing a range of winching tasks over a wide range of cable lengths, sizes and loads.

It is further object of at least one aspect of the present invention to provide an improved gripper assembly that is capable of improving the performance of a linear winch assembly in which the gripper assembly is deployed.

It is another object of an aspect of the present invention to provide a robust, reliable, sturdy linear winch assembly suitable for deployment in a wide range of winching applications which is capable of passing a cable connector whilst maintaining the tension on the cable and prolonging the working lifespan of the linear winch assembly.

Further aims and objects of the invention will become apparent from reading the following description.

According to a first aspect of the invention, there is provided a linear winch assembly comprising:

a first gripper assembly comprising a first gripper block;

a second gripper assembly comprising a second gripper block;

a first mechanism operable to move at least part of the first gripper block out of the pathway of a cable connector to allow the connector to pass through the first gripper assembly and a second mechanism operable to move at least part of the second gripper block out of the pathway of a cable connector to allow the connector to pass through the second gripper assembly.

The above described linear winch assembly may facilitate the passing of a cable connector through the linear winch assembly whilst maintaining the tension on the cable. This may facilitate the efficient winching of long lengths of cable formed from a series of short cables joined by connectors.

By providing a linear winch assembly with at least part of the gripper blocks capable of moving out of the pathway of a cable connector, the winch assembly may facilitate the passing of a cable connector through the body of the winch assembly without the use of a crane or lifting mechanism. This may avoid dangerous, cumbersome and time consuming operations which are required when using a crane or lifting mechanism to lift the tensioned cable out of the pathway of components of the linear winch assembly.

Preferably the first mechanism is configured move the at least part of the first gripper block to a position which is out of the pathway of the cable connector, wherein the position may be within a linear winch housing. Further preferably the second mechanism is configured to move the at least part of the second gripper block to a position which is out of the pathway of the cable connector, wherein the position may be within a linear winch housing.

The first mechanism may be configured to move the at least part of the first gripper block laterally, vertically and/or horizontally to a position out of the pathway of a cable connector. The first mechanism may be configured to rotate, lower, raise and/or displace the at least part of the first gripper block to move out it out of the pathway of the cable connector.

The second mechanism may be configured to move the at least part of the second gripper block laterally, vertically and/or horizontally to a position out of the pathway of the cable connector. The second mechanism may be configured to rotate, lower, raise and/or displace the at least part of the second gripper block to move out it out of the pathway of the cable connector.

The first mechanism may be configured to move the at least part of the first gripper block from an operative position in which the first gripper block is in the pathway of a cable connector to an inoperative position in which the first gripper block is not in the pathway of a cable connector.

The inoperative position of the first gripper block may be laterally, vertically and/or horizontally offset from the operative position of the first gripper block.

The cable connector may extend radially outward from the cable to a first radial distance. The inoperative position of the first gripper block may be laterally, vertically and/or horizontally offset from the operative position of the first gripper block by a distance equal to or greater than the first radial distance of the cable connector to allow the cable connector to pass through the first gripper assembly.

The second mechanism may be configured to move the at least part of the second gripper block from an operative position in which the second gripper block is in the pathway of a cable connector to an inoperative position in which the second gripper block is not in the pathway of a cable connector.

The inoperative position of the second gripper block may be laterally, vertically and/or horizontally offset from the operative position of the second gripper block.

The cable connector may extend radially outward from the cable to a first radial distance. The inoperative position of the at least part of the second gripper block may be laterally, vertically and/or horizontally offset from the operative position of the at least part of the second gripper block by a distance equal to/or greater than the first radial distance of the cable connector to allow the cable connector to pass through the second gripper assembly.

Preferably, the first mechanism may be configured to move the at least part of the first gripper block to a vertically lower position which is out of the pathway of the cable connector, wherein the position may be within a linear winch housing.

Preferably, the second mechanism may be configured to move the at least part of the second gripper block to a vertically lower position which is out of the pathway of the cable connector, wherein the lower position may be within a linear winch housing.

The first mechanism may be configured to move the at least part of the first gripper block in a direction substantially transverse to the direction of travel of the cable and/or cable connector. The second mechanism may be configured to move the at least part of the second gripper block in a direction substantially transverse to the direction of travel of the cable and/or cable connector.

The first mechanism and/or second mechanism may comprise a hydraulic, pneumatic, electric or mechanical actuator. In some embodiments, the actuator is a hydraulic cylinder. Preferably the first gripper assembly and/or the second gripper assembly are configured to sequentially grip and release a cable. The first gripper assembly and the second gripper assembly may be configured to grip the cable simultaneously. One gripper assembly may be configured to grip the cable while the other gripper assembly releases the cable.

The linear winch assembly may facilitate a wide variety of cable lengths, sizes and loads which may result in improved productivity and/or efficiency.

The linear winch assembly may be used to winch a wide variety of cables including but not limited to lines, tether, rope, wire, wire rope, rods, umbilical, pipe, cord or conduit.

Preferably the first gripper assembly comprises a lid. Preferably the second gripper assembly comprises a lid. The lid may provide structural support and strength to the first and/or second gripper assembly. The lid may facilitate the gripper assembly and/or gripper block to direct a clamping force on the cable.

Preferably the first gripper assembly comprises a mechanism configured to open and close the lid. Preferably the second gripper assembly comprises a mechanism configured to open and close the lid.

The gripper block and/or lid may be configured to be moved to a position outside the winch assembly. The lid and/or gripper block may be configured to be moved to a position inside the winch assembly.

Preferably the linear winch assembly comprises a control unit. The control unit may be configured to control the operation of the linear winch. The control unit may be configured to control the reciprocating motion of the gripper assemblies along the longitudinal axis of the winch housing.

The control unit may be configured to control the laterally, vertically and/or horizontally positions of the gripper assemblies to enable controlled passing of the cable connector through the gripper assemblies. The control unit may be configured to control the position of the gripper assemblies in relation to one another to facilitate efficient winching.

The control unit may be configured to control the laterally, vertically and/or horizontally position of the gripper blocks and lids to control the passing of the cable connector through the gripper assemblies.

The control unit may be configured use feedback information relating to the position of the gripper assemblies, the positions of the cable connector and/or the stroke length of actuator to ensure that cable is winched and the cable connector is passed through the winch in the most efficient manner.

The control unit may be configured to monitor the position of the cable connector and/or gripper assemblies to ensure that the gripper assemblies are located in a correct position to allow the cable connector to pass in an orderly manner and mitigate cable tension, impacts and/or contact between the cable connector and the gripper assemblies.

Preferably the cable connector is selected from Spelter sockets, mooring sockets, wedge sockets and/or wire rope clips.

According to a second aspect of the invention, there is provided a linear winch assembly comprising:

a first gripper assembly comprising a lid and a first gripper block;

a second gripper assembly comprising a lid and a second gripper block;

a first mechanism operable to move at least part of the first gripper block out of the pathway of a cable connector to allow the connector to pass through the first gripper assembly; and a second mechanism operable to move at least part of the second gripper block out of the pathway of a cable connector to allow the connector to pass through the second gripper assembly.

The first mechanism may be configured to move the at least part of the first gripper block laterally, vertically and/or horizontally out of the pathway of a cable connector. The first mechanism may be configured to rotate, lower, raise and/or displace at least part of the first gripper block to move out it out of the pathway of a cable connector.

The second mechanism may be configured to move the at least part of the second gripper block laterally, vertically and/or horizontally out of the pathway of a cable connector. The second mechanism may be configured to rotate, lower, raise and/or displace the at least part of the second gripper block to move out it out of the pathway of a cable connector.

The first mechanism may be configured to move at least part of the first gripper block to a position which is out of the pathway of a cable connector, wherein the position is within the housing of the linear winch assembly.

The second mechanism may be configured to move at least part of the second gripper block to a position which is out of the pathway of a cable connector, wherein the position is within the housing of the linear winch assembly.

Preferably, the first mechanism may be configured to lower at least part of the first gripper block to a position within the housing of the linear winch assembly. Preferably, the second mechanism may be configured to lower at least part of the second gripper to a position within the housing of the linear winch assembly.

Preferably the first gripper assembly comprises a mechanism configured to open and close the lid. Preferably the second gripper assembly comprises a mechanism configure to open and close the lid.

Embodiments of the second aspect of the invention may include one or more features of the first aspect of the invention or its embodiments, or vice versa.

According to a third aspect of the invention, there is provided a gripper assembly for a linear winch assembly comprising:

a lid;

a gripper block; and a mechanism operable to move at least part of the gripper block out of the pathway of a cable connector to allow the cable connector to pass through the gripper assembly.

The mechanism is configured to move the at least part of gripper block in a rotary, linear and/or translational movement out of the pathway of the cable connector.

The mechanism may be configured to move the at least part of gripper block laterally, vertically and/or horizontally out of the pathway of the cable connector.

The mechanism may be configured to move the at least part of the gripper block to a position out of the pathway of a cable connector to allow the connector to pass through the gripper assembly, wherein the position is within a gripper assembly housing.

The mechanism may be configured to move at least part of the gripper block between an operative position in which the gripper block is in the pathway of a cable connector and an inoperative position in which the gripper block is not in the pathway of a cable connector.

The inoperative position of the gripper block may be laterally, vertically and/or horizontally offset from the operative position of the gripper block.

The cable connector may extend radially outward from the cable to a first radial distance. The inoperative position of the gripper block may be laterally, vertically and/or horizontally offset from the operative position of the gripper block by a distance equal to or greater than the first radial distance of the cable connector to allow the cable connector to pass through the gripper assembly.

The lid may be movably mounted on the gripper assembly. The lid may be configured to be moved to a position out of the pathway of the cable connector. Preferably the lid is pivotally mounted on the gripper assembly.

The gripper block may be configured to be rotated, lowered, raised and/or displaced to a position out of the pathway of the cable connector. Preferably, the mechanism may be configured to move the at least part of the gripper block to a vertically lower position which is out of the pathway of the cable connector, wherein the lower position may be within a gripper assembly housing.

Preferably the gripper block is movably mounted on a guide assembly.

The mechanism may be configured to move the at least part of the gripper block to a position parallel to the longitudinal axis of the cable connector and/or linear winch assembly housing. The mechanism may be configured to move the at least part of the gripper block to a position perpendicular to the longitudinal axis of the cable connector and/or gripper assembly housing.

Embodiments of the third aspect of the invention may include one or more features of the first or second aspect of the invention or their embodiments, or vice versa According to a fourth aspect of the invention, there is provided a method of operating a linear winch assembly, the method comprising:

providing a linear winch assembly comprising:

at least one gripper assembly comprising a lid and a gripper block; and a mechanism operable to move at least a part of the gripper block out of the pathway of a cable connector;

moving at least a part of the gripper block out of the pathway of a cable connector;

and passing the cable connector through the gripper assembly.

The method may comprise moving the at least a part of the gripper block around the cable connector to pass the cable connector through the gripper assembly. The method may comprise moving the at least one gripper assembly to pass the cable connector through the gripper assembly.

The method may comprise pulling in or paying out the cable to pass the cable connector through the gripper assembly. The method may comprise providing a second gripper assembly configured to pull in or pay out a cable. A second gripper assembly may be provided and may be configured to pull the cable and cable connector through the first gripper assembly.

The method may comprise moving the at least part of the gripper block laterally, vertically and/or horizontally out of the pathway of a cable connector.

The method may comprise:

providing a second gripper assembly comprising:

a second lid;

a second gripper block; and a second mechanism operable to move at least a part of the second gripper block out of the pathway of a cable connector to allow the connector to pass through the second gripper block;

moving at least a part of the second gripper block out of the way of a cable connector;

pulling in or paying out a cable; and passing the cable connector through the second gripper assembly.

Embodiments of the fourth aspect of the invention may include one or more features of the first to third aspects of the invention or their embodiments, or vice versa.

According to a fifth aspect of the invention, there is provided a method of operating a linear winch assembly comprising the steps of:

providing a linear winch assembly comprising:

a first gripper assembly comprising:

a lid;

a first gripper block and a first mechanism operable to move at least a part of the first gripper block from an operative position in which the first gripper block is in the pathway of a cable connector to an inoperative position in which the first gripper block is not in the pathway of a cable connector;

moving at least a part of the first gripper block from the operative to the inoperative position; and passing the cable connector through the first gripper assembly.

The method may comprise moving the first gripper block around the cable connector to pass the cable connector through the gripper block.

The method may comprise moving the at least part of the first gripper block laterally, vertically and/or horizontally out of the pathway of the cable connector.

The inoperative position of the first gripper block may be laterally, vertically and/or horizontally offset from the operative position of the first gripper block.

The method may comprise pulling in or paying out the cable to pass the cable connector through the gripper assembly.

The method may comprise moving the at least part of the first gripper block from an inoperative position to the operative position when the cable connector has passed through the gripper assembly.

The method may comprise providing:

a second gripper assembly comprising a lid;

a second gripper block and a second mechanism operable to move at least a part of the second gripper block from an operative position in which the second gripper block is in the pathway of a cable connector to an inoperative position in which the second gripper block is not in the pathway of a cable connector;

moving at least a part of the second gripper block from the operative to the inoperative position; and passing the cable connector through the second gripper assembly.

The method may comprise moving the at least part of the second gripper block from the inoperative position to the operative position when the cable connector has passed through the second gripper assembly.

The method may comprise moving the at least part of the first and/or second gripper block laterally, vertically and/or horizontally out of the pathway of the cable connector.

The method may comprise moving the second gripper block around the cable connector to pass the cable connector through the second gripper block.

The method may comprise the step of moving the at least part of the first and/or second gripper assembly to pull in or pay out a cable.

The method may comprise rotating, lowering, raising and/or displacing at least part of the first and/or second gripper blocks to move out it out of the pathway of a cable connector.

Embodiments of the fifth aspect of the invention may include one or more features of the first to fourth aspects of the invention or their embodiments, or vice versa According to a sixth aspect of the invention, there is provided a method of operating a gripper assembly comprising the steps of:

providing a gripper assembly comprising a lid;

a gripper block; and a mechanism operable to move at least part of the gripper block;

moving at least part of the gripper block out of the pathway of a cable connector; and passing the cable connector through the gripper assembly.

The method may comprise actuating the mechanism to move the gripper block out of the pathway of a cable connector.

The method may comprise moving the at least part of the gripper block laterally, vertically and/or horizontally out of the pathway of the cable connector.

The method may comprise moving the lid out of the pathway of the cable connector.

Embodiments of the sixth aspect of the invention may include one or more features of the first to fifth aspects of the invention or their embodiments, or vice versa.

According to a seventh aspect of the invention, there is provided a method of operating a linear winch assembly, the method comprising:

providing a linear winch assembly comprising:

a first gripper assembly comprising a first lid and a first gripper block;

a first mechanism operable to move at least a part of the first gripper block;

a second gripper assembly comprising a second lid and a second gripper block;

a second mechanism operable to move at least a part of the second gripper block;

actuating the first mechanism to move at least a part of the first gripper block out of the pathway of a cable connector;

passing the cable connector through the first gripper assembly;

actuating the second mechanism to move at least a part of the second gripper block out of the pathway of a cable connector; and passing the cable connector through the second gripper assembly.

The method may comprise actuating the first mechanism to move the at least part of first gripper block laterally, vertically and/or horizontally out of the pathway of the cable connector.

The method may comprise actuating the second mechanism to move the at least part of second gripper block laterally, vertically and/or horizontally out of the pathway of the cable connector.

The method may comprise pulling in or paying out the cable to pass the cable connector through the first and/or second gripper assemblies.

The method may comprise moving the second gripper assembly to push or pull the cable connector through the first gripper assembly. The method may comprise moving the first gripper assembly to push or pull the cable connector through the second gripper assembly.

The method may comprise moving the first gripper assembly to move the cable connector through the first gripper and/or first gripper assembly. The method may comprise moving the second gripper assembly to pass the cable connector through the second gripper block and/or second gripper assembly.

Embodiments of the seventh aspect of the invention may include one or more features of the first to sixth aspects of the invention or their embodiments, or vice versa

BRIEF DESCRIPTION OF THE DRAWINGS

There will now be described, by way of example only, various embodiments of the invention with reference to the following drawings (like reference numerals referring to like features) in which.

DETAILED DESCRIPTION OF PREFERRED EMBODIMENTS

An embodiment of the present invention is illustrated in FIG. 1 and provides a number of advantages over prior art linear winches, specifically by providing robust and sturdy gripper assemblies, components of which are capable of being moved out of the pathway of a cable connector such as a socket so that the connector may pass through the winch. The linear winch is capable of performing a wide range of winching and tasks in a safe and time efficient manner.

Figure 1A:
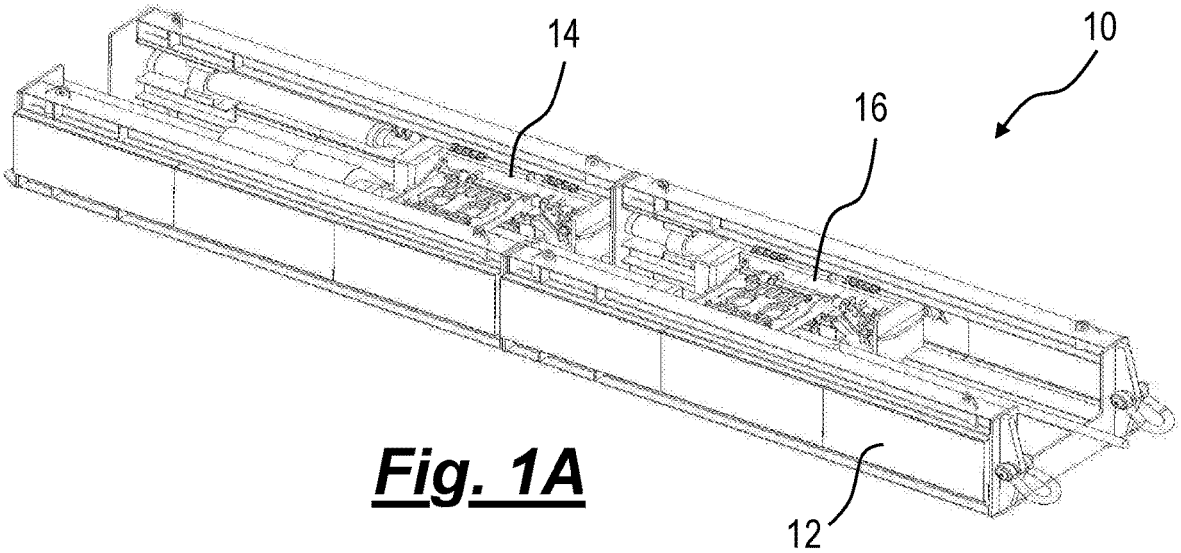
FIGS. 1A and 1B present a linear winch comprising two gripper assemblies in accordance with an embodiment the present invention, shown in perspective view.
Figure 1B:
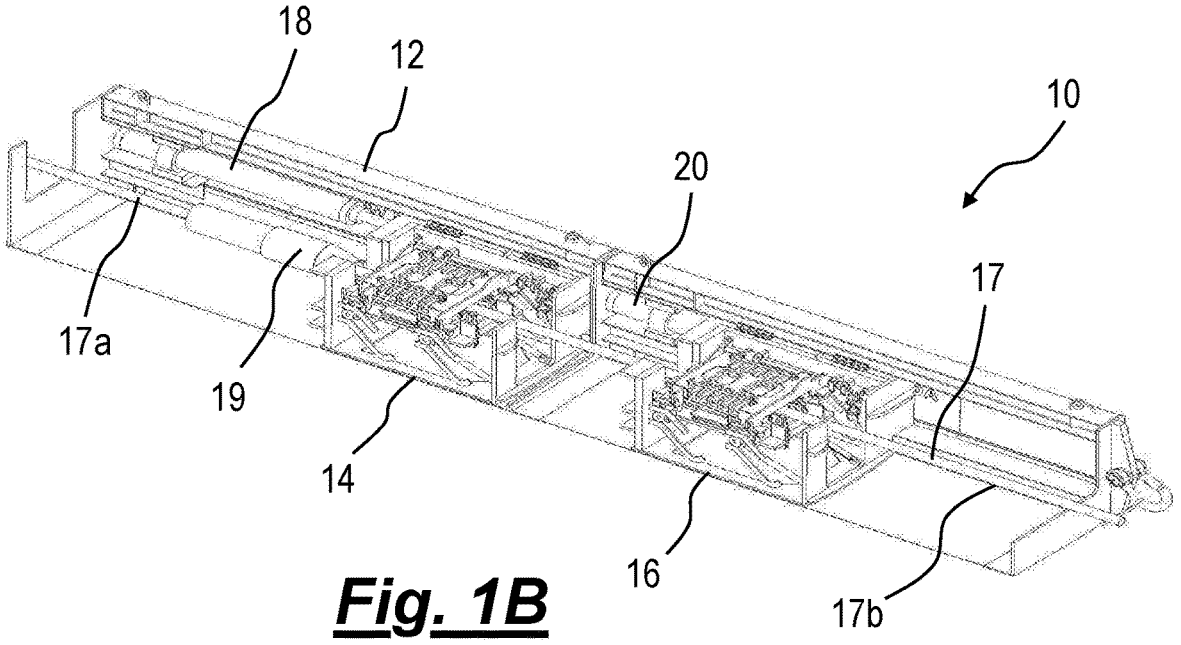

FIGS. 1A and 1B shows perspective views of linear winch assembly 10. The linear winch assembly 10 has a housing 12. One side of the winch assembly in FIG. 1B has been removed to improve the clarity of the drawing. The winch housing 11 can be seen to comprise a first gripper assembly 14 and a second gripper assembly 16. The first gripper assembly 14 and a second gripper assembly 16 are slidably mounted within housing 12.

Hydraulic cylinders 18 and 20 are mounted in the housing 12 and are connected to the gripper assemblies 14 and 16 respectively. The gripper assembly 14 is configured to be moved in reciprocating action along the longitudinal axis of the housing 12 by the extension and retraction of hydraulic cylinder 18. The gripper assembly 16 is configured to be moved in reciprocating action along the longitudinal axis of the housing 12 by the extension and retraction of hydraulic cylinder 20.

The gripper assemblies 14 and 16 are designed to engage and grip a cable 17. The hydraulic cylinders 18 and 20 are configured to move the gripper assemblies and the gripped cable 17 along the longitudinal axis of the linear winch assembly.

FIG. 1B shows hydraulic cylinder 18 in a fully extended position and hydraulic cylinder 20 in a fully retracted position. A connector socket 19 is used to connect two sections of cable 17*a* and 17*b*. The socket 19 is shown in FIG. 1B positioned close to the gripper assembly 14 but is unable to pass though the gripper assembly 14 as there is not sufficient clearance to allow the socket 19 to pass through gripper assembly 14.

Figure 2A:
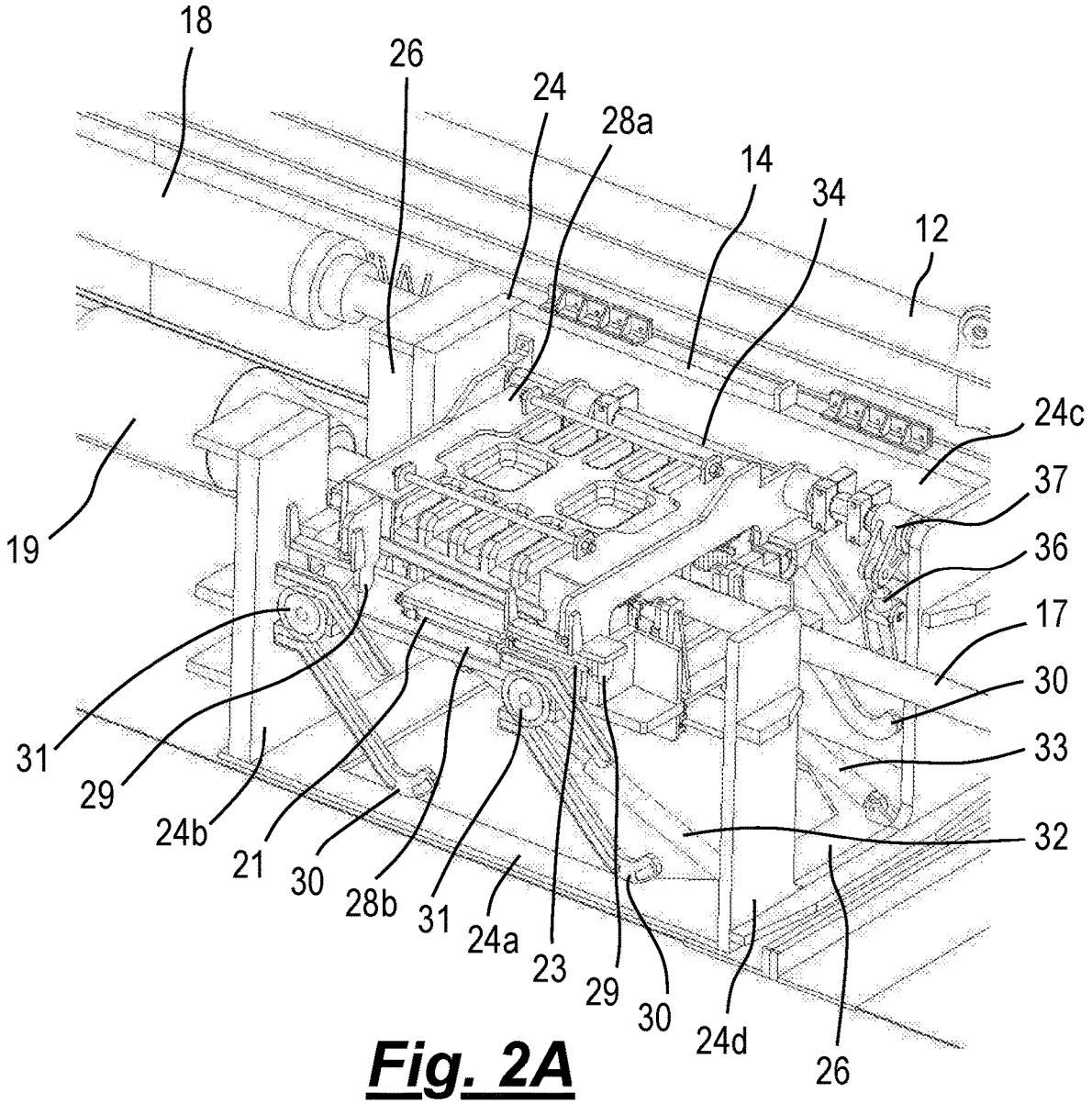
FIGS. 2A and 2B present gripper assembly of the linear winch of FIG. 1B, shown in an enlarged perspective views.
Figure 2B:
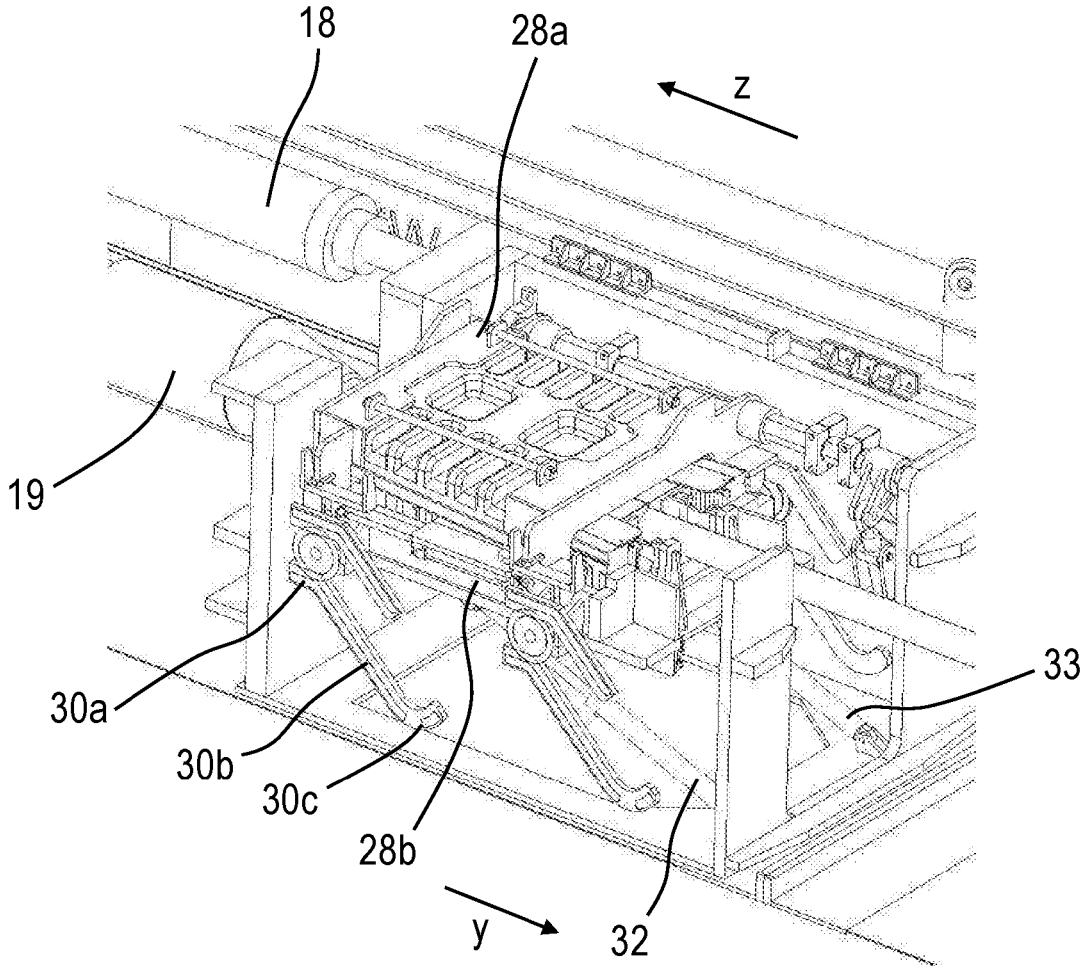

FIGS. 2A and 2B shows an enlarged perspective view of the gripper assembly 14. The gripper assembly 14 comprises a gripper housing 24 having a base 24*a* and four walls 24*b*, 24*c*, 24*d* and 24*e*. Wall 24*e* has been removed from FIG. 2 to improve the clarity of the drawing. The walls 24*b* and 24*d* are perpendicular to the longitudinal axis of the winch assembly and have slots 26 which are dimensioned to allow a cable 17 and socket 19 to pass through the walls 24*b* and 24*d*.

Hydraulic cylinder 18 is connected at one end to the wall 24*b* of the gripper housing 24 and is configured to slidably move the gripper housing 24 along the longitudinal axis of the winch housing 12.

The gripper housing 24 comprises a lid section 28*a* and a gripper block 28*b*. The lid section 28*a* is slidably mounted on the gripper block 28*b*. Hydraulic cylinders 21 and 23 are connected to the gripper block 28*b* and are configured to engage with lid members 29 to slide the lid section 28*a* relative to the gripper block 28*b* along the longitudinal axis of the housing 12 by the extension and retraction of hydraulic cylinders 21 and 23. The lid section 28*a* is configured to be slidably moved between a locked position shown in FIG. 2A and an unlocked position shown in FIG. 2B.

The lid section 28*a* is pivotally and slidably mounted on the gripper housing 24 via a rod 34 which is connected to the walls of the gripper housing 24. A hydraulic cylinder 36 is connected to rod 34 via a coupling 37. The rod 34 has a hexagonal cross-section. The hydraulic cylinder 36 and coupling 37 are configured to engage rod 34 to pivotally move the lid section 28*a* between open and closed positions. Although, this example shows a hexagonal cross-section rod and hydraulic cylinder to pivotally move the lid section between open and closed positions it will also be clear that other rod cross sections and/or other mechanisms may be used.

The gripper block 28*b* is movably mounted on guide rails 30 via guide wheels 31 mounted on a base section of the gripper block 28*b*. Hydraulic cylinders 32 and 33 are connected at one end to the gripper block 28*b* and to the base 24*a* of the gripper housing 24 at the other end. The hydraulic cylinders 32 and 33 are configured to move the gripper block 28*b* along the sloped pathway of the guide rails 30. By moving the guide wheels 31 of the gripper block 28*b* along the sloped pathway of the guide rails 30 the gripper block 28*b* is lowered out of the pathway of the cable 17 and/or socket 19.

Although, this example shows guide rails 30 and guide wheels 31 are used to lower the gripper block 28*b* out of the pathway of the cable 17 and socket 19 other guide arrangements and/or mechanisms may be used. It will also be clear that other assembly components may be moved in other directions to move the assembly out of the pathway of the cable 17 and socket 19.

The lid section 28*a* and gripper block 28*b* have a wedge shape. The dimensions of the lid section 28*a* and gripper block 28*b* are such that when the wedge shape lid section 28*a* is positioned on top of the corresponding wedge shape gripper block 28*b* and moved by the actuation of hydraulic cylinders 21 and 23 in a general direction Y along the longitudinal axis of the housing 12, the inner surfaces of the wedged shape lid section 28*a* bears against the outer surfaces of the wedged shape gripper block 28*b*. In this position the lid is clamped onto the gripper block 28*b*. FIG. 2A shows the lid section 28*a* in a clamped position.

However, actuation of hydraulic cylinders 21 and 23 to move lid section 28*a* in a general direction Z along the longitudinal axis of the housing 12 causes the inner surfaces of the wedged shape lid section 28*a* to move away from the outer surfaces of the wedged shape gripper block 28*b*. In this position the lid is released from the gripper block 28*b*. FIG. 2B shows the lid section 28*a* in a released position.

Figure 3A:
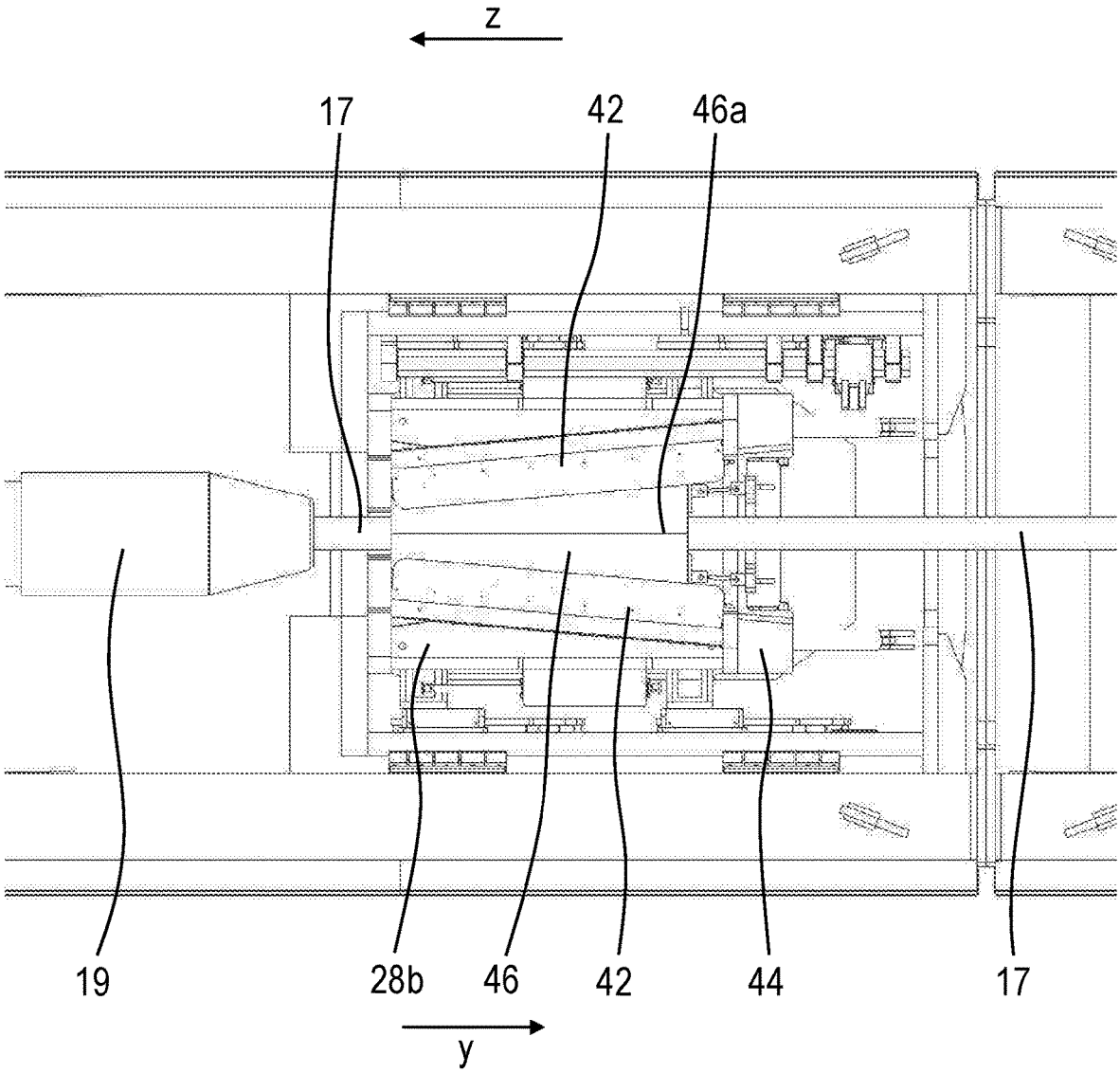
FIGS. 3A, 3B and 3C present enlarged plan, perspective and cross-sectional views of the gripper assembly of the linear winch of FIG. 1B.
Figure 3B:
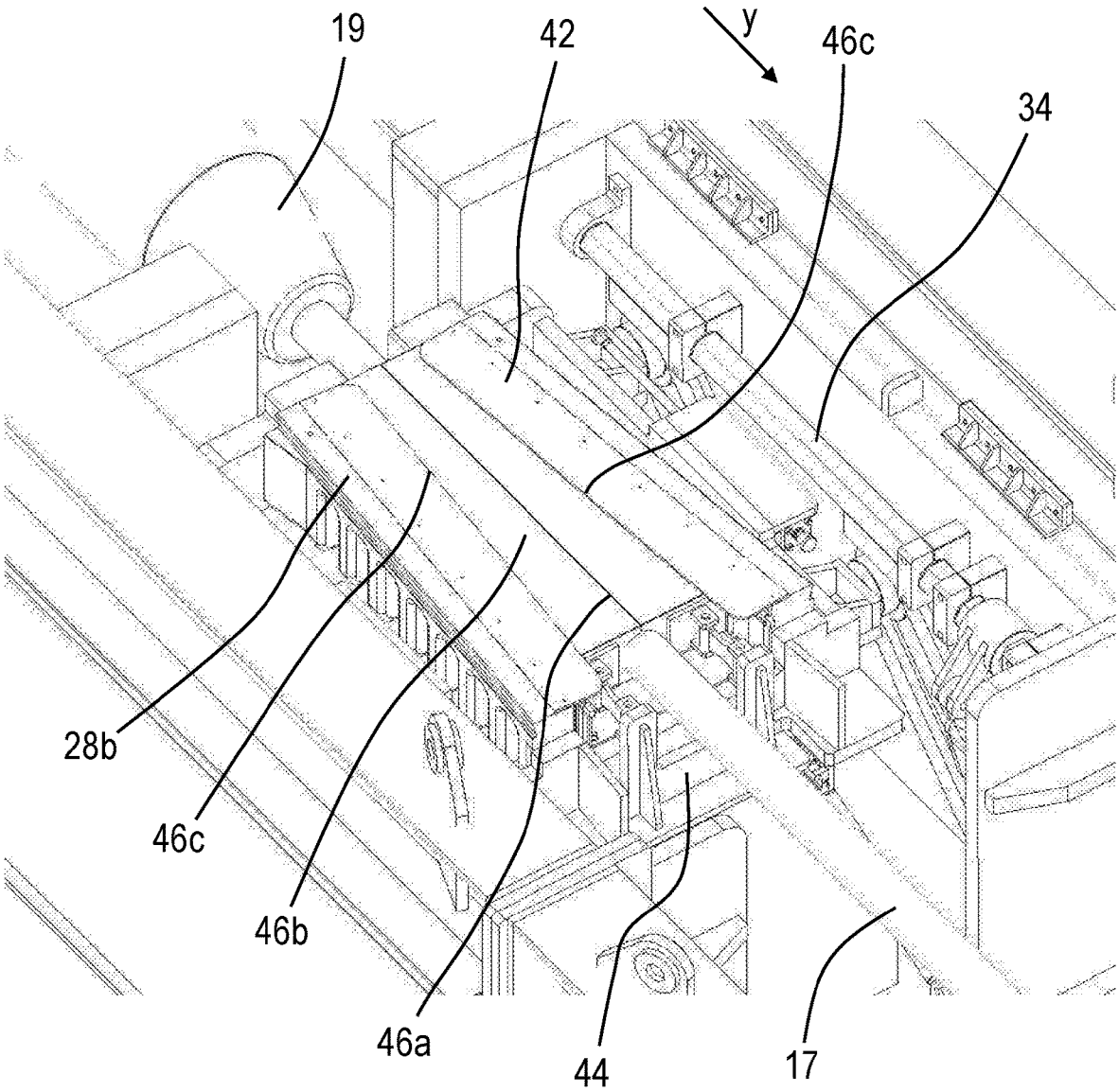
Figure 3C:
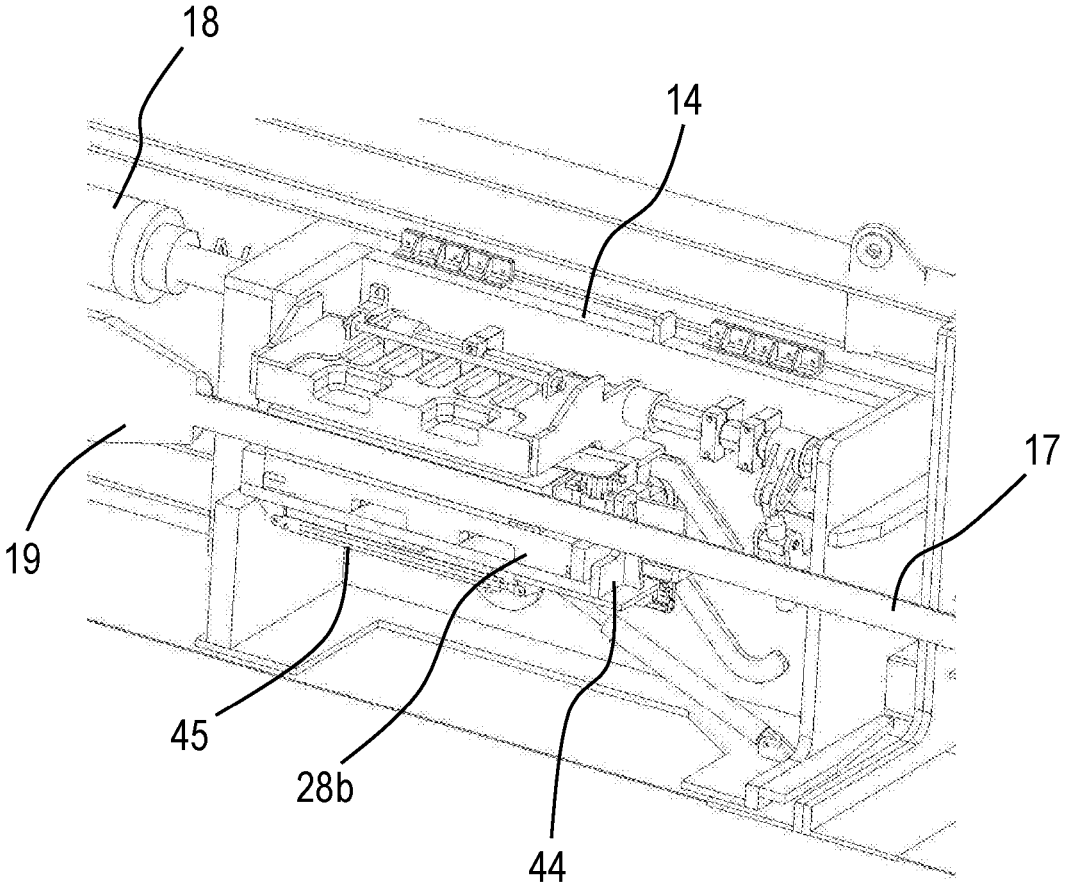

FIGS. 3A, 3B and 3C show an enlarged plan, perspective and cross-sectional views of the gripper assembly 14. The lid section 28*a* has been removed for clarity. The gripper block 28*b* comprises two parallel bearing members 42 mounted on the gripper block 28*b* in a generally wedged shape. The gripper block 28*b* comprises a gripper slider 44 which houses two clamp members 46.

The clamp members 46 have inner faces 46*a* which have longitudinal semi-cylindrical grooves 46*b* that are dimensioned to receive the cable 17. The size and shape of the semi-cylindrical grooves 46*b* may be changed for different cable sizes and/or types.

The gripper block 28*b* is configured to restrain and grip the cable 17 and pull the cable in a first direction as shown by arrow Y in FIG. 3A and to release the cable and allow the cable to move freely relative to the gripper block in the opposite direction of travel represented by arrow Z in FIG. 3A.

The outer surfaces 46*c* of the clamp members 46 have a wedge shape. The clamp members 46 are configured to move perpendicular to the longitudinal axis of the housing 12 to bear against bearing members 42 when the gripper block 28*b* is moved in a general direction Y. When the movable clamp members are moved in the direction Y, they transmit a force to the bearing members 42. The bearing members 42 are fixed in the base section of the gripper block 28*b* which causes a reaction force against the inner surfaces of the clamp members 46 to clamp on to and grip the cable 17.

When the gripper block 28*b* is moved in a direction shown by arrow Z in FIG. 3A, clamp members 46 move away from the wedge bearing members 42. The reaction force acting against the clamp members 46 by the bearing members 42 is reduced. The inner surfaces of the clamp members 44 are moved away from the cable 17. The cable is free to move within the clamp members 46 and the gripper assembly 14.

FIG. 3C shows a hydraulic cylinder 45 connected at one end to the base section of the gripper block 28*b* and to gripper slider 44 at the other end. The gripper slider 44 is configured to be moved between a cable engaged position as shown in FIG. 3B and a cable release position as shown in FIG. 4A.

In the cable engaged position as shown in FIG. 3B the gripper slider is located in the gripper block 28*b* between the bearing members 42. The clamp members 46 are moved toward one another to engage the cable in the longitudinal semi-cylindrical grooves 46*b*.

Figure 4A:
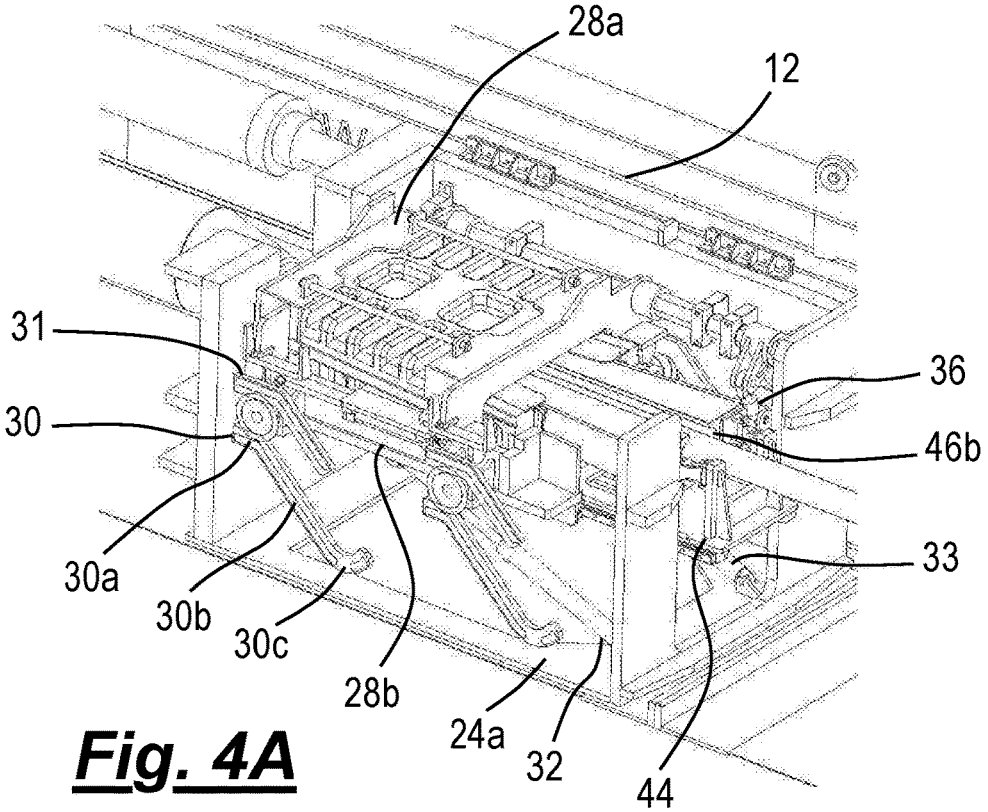
FIGS. 4A, 4B and 4C presents the gripper assembly of FIG. 1B in cross-sectional view and perspective views during stages of moving to a inoperative position with a wall of the gripper assembly removed for clarity.

In the cable release position as shown in FIG. 4A the gripper slider 44 is located partially outside the gripper block 28*b*. The clamp members 46 are moved away from one another to allow the cable to be removed from the longitudinal semi-cylindrical grooves 46*b*.

Figure 4B:
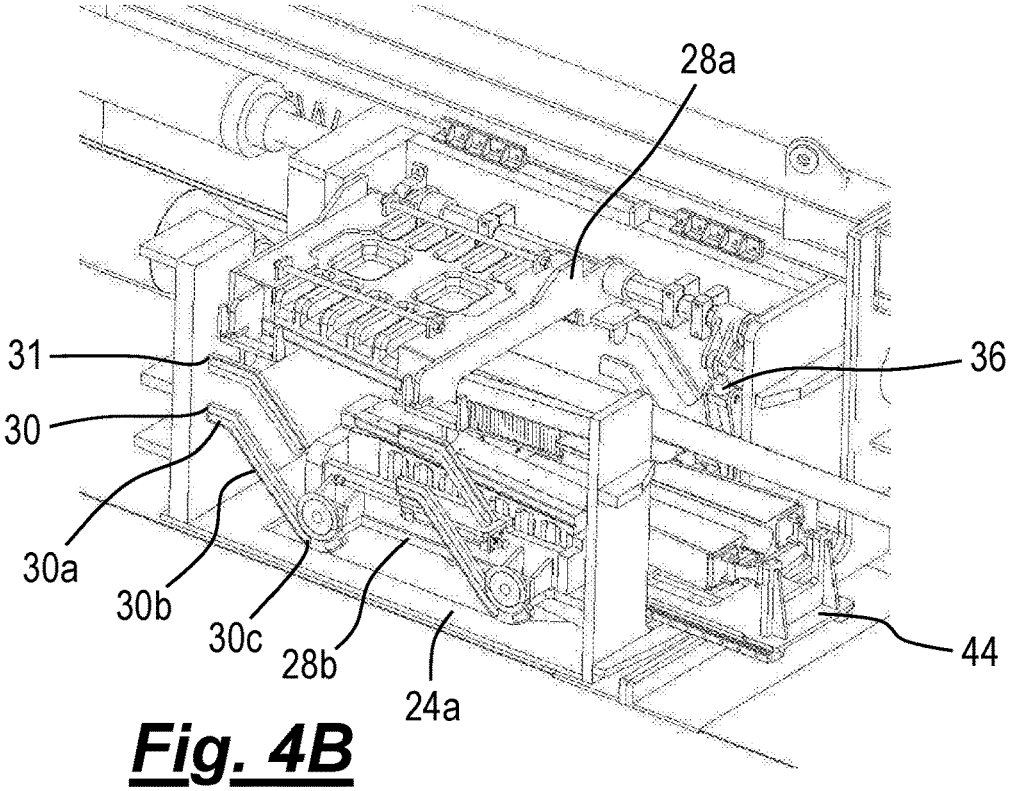
Figure 4C:
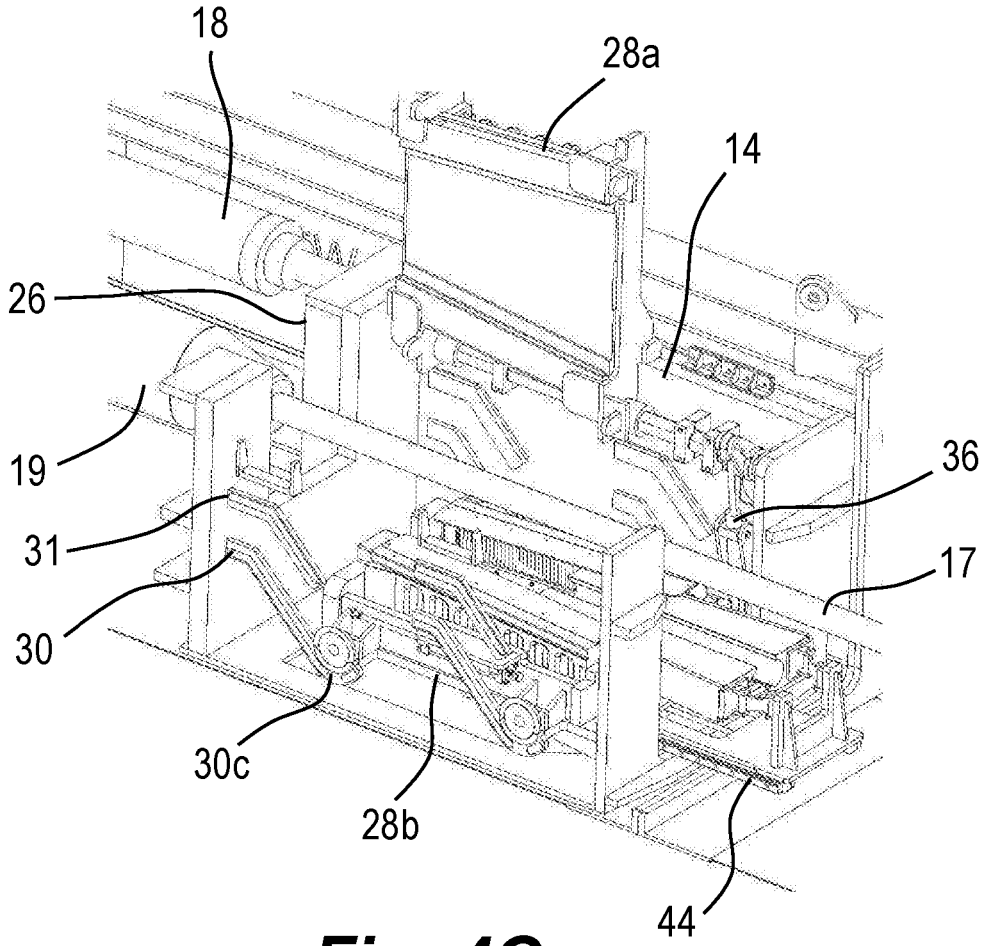

FIG. 4A to 4C presents the gripper assembly during stages of socket passing in cross-sectional view and perspective views with a wall of the gripper assembly removed for clarity.

The hydraulic cylinder 45 (shown in FIG. 3C) is actuated to move the gripper slider 44 from a cable engaged position to a cable release position as shown in FIG. 4A. The gripper slider 44 is located partially outside the gripper block 28*b*. The clamp members 46 are moved away from one another to allow the cable to be removed from the longitudinal semi-cylindrical grooves 46*b*.

The gripper assembly comprises guide rails 30. Each guide rail 30 comprises a first part 30*a* which positions the gripper block 28*b* at an operative position in which the gripper block is in the pathway of the cable connector at an elevated position above the base 24*a* of the gripper assembly 14. Each guide rail 30 comprises a second part 30*b* provides a sloped guide path; and a third part 30*c* which positions the gripper block 28*b* at an inoperative position in which the gripper block is not in the pathway of a cable connector and is close to the base 24*a* of the gripper assembly 14.

Upper guide rails 31 are located above the first part 30*a* of guide rail 30 and partially along second part 30*b* to ensure that the gripper block 28*b* is accurately positioned in the operative position.

The operative position of the gripper block 28*b* may be defined as the position that the gripper block 28*b* is located during normal winching of the cable by the gripper assembly 14. The inoperative position of the gripper block 28*b* may be defined as the position wherein the gripper block 28*b* is located at the third part 30*c* of guide rail 30 out of the pathway of the socket 19 to allow socket 19 to pass through the gripper assembly 14.

The operative position of the lid section 28*a* may be defined as the position that the lid section 28*a* is located during normal winching of the cable by the gripper assembly 14. The inoperative position of the lid section 28*a* may be defined as the position wherein the lid section 28*a* is moved to an open position.

Guide rails 30 are configured to receive wheels which are connected to the base section of the gripper block 28*b* as shown in FIG. 4A. Hydraulic cylinders 32 and 33 are actuated to pull the gripper block 28*b* along guide rails 30. This action lowers the gripper block away from the lid section. The hydraulic cylinders 32 and 33 are configured to position the gripper block at the third part 30*c* of guide rail 30 when the cylinders are at their fully retracted position as shown in FIG. 4B. At this lower position the gripper block 28*b* is moved out of the pathway of the socket 19.

Hydraulic cylinder 36 is actuated to pivot the lid section 28*a* between a closed position and an open position. FIG. 4C shows the gripper assembly 14 in a socket pass position. In the socket pass position the gripper block 28*b* is located at the third part 30*c* of guide rail and the lid section 28*a* is pivoted to an open position. The gripper block 28*b* and lid section 28*a* have been moved out of the pathway of the cable socket 19. The socket now has sufficient clearance to pass though the gripper assembly 14.

Although this example describes the gripper block being moved vertically out of the pathway of the cable connector. It will be clear that alternatively the gripper block may be moved in laterally, horizontally and/or vertically out of the pathway of the cable connector.

Figure 5A:
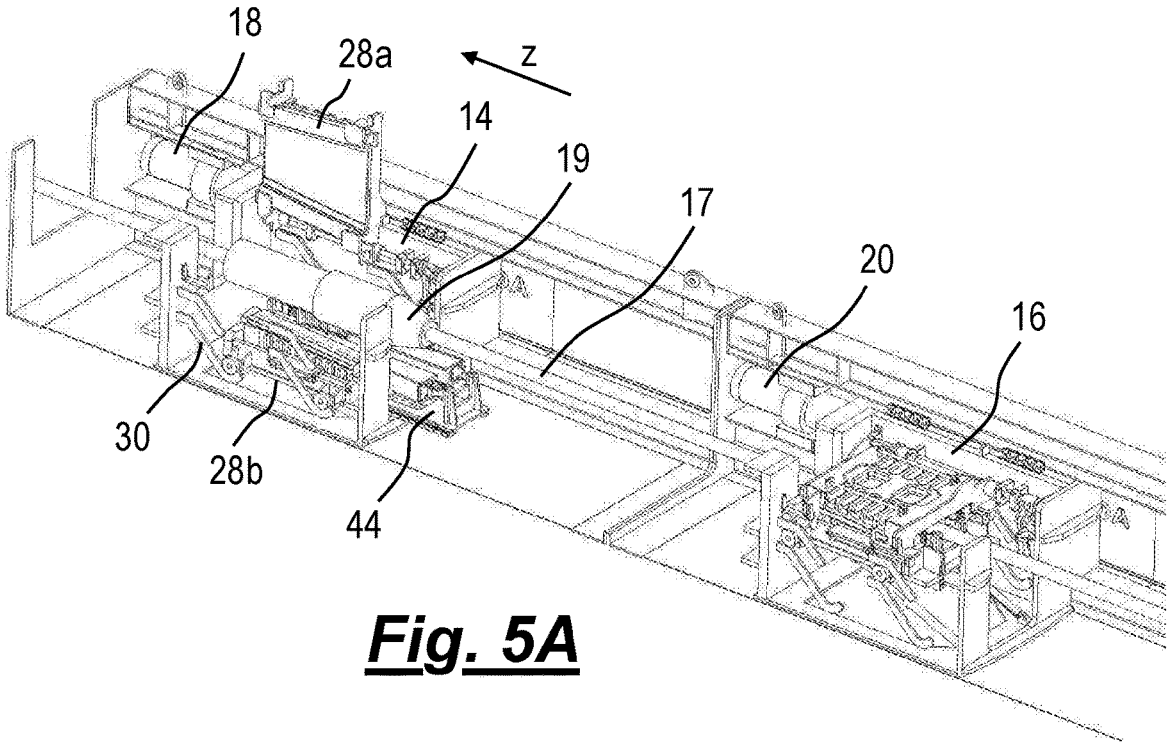
FIGS. 5A and 5B shows perspective views of the linear winch during stages of the cable connector passing through the gripper assembly.
Figure 5B:
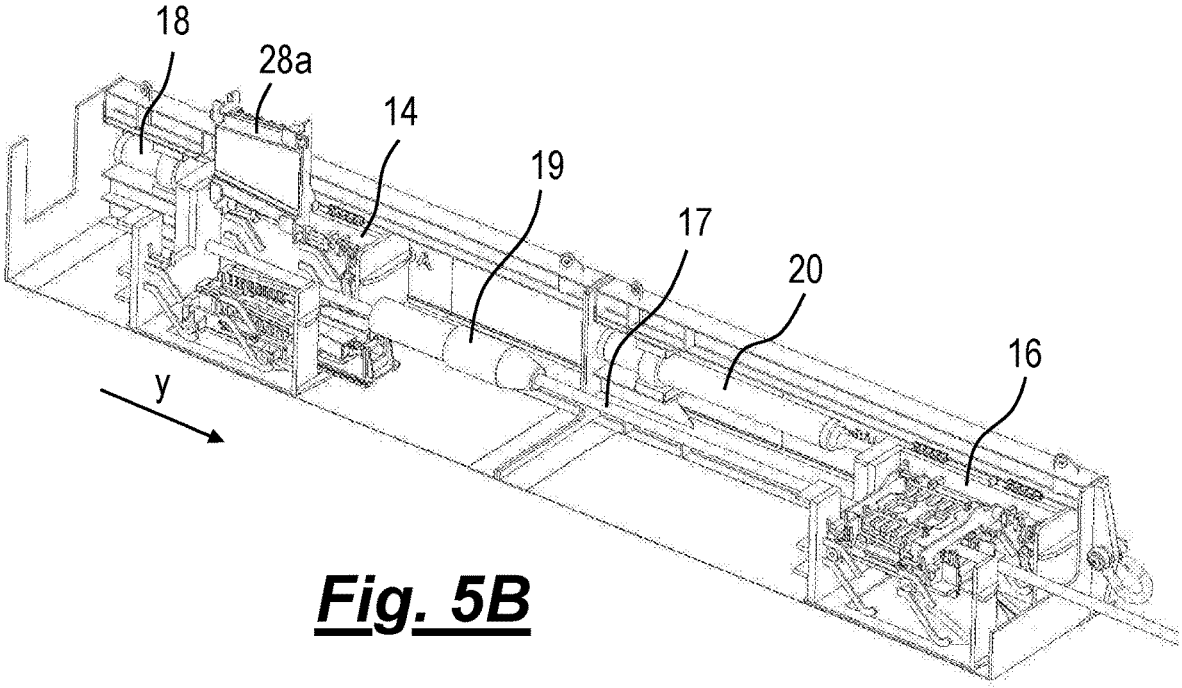

FIGS. 5A and 5B shows perspective views of the linear winch with the gripper assembly 14 in an inoperative socket pass configuration to provide details on the movement of the socket through the gripper assembly 14. The hydraulic cylinder 18 is actuated to a retracted position to move the gripper assembly 14 in a direction shown as arrow Z in FIG. 5A to move the gripper assembly around the socket 19. The socket 19 is able to pass through the slot 26 in the gripper assembly 14. The inoperative state of the gripper assembly provides clearance for the socket 19. The retraction of hydraulic cylinder 18 moves the gripper assembly 14 such that the socket is positioned within the gripper assembly 14. In order to fully pass the socket through the gripper assembly 14 the cable and socket is pulled by the second gripper assembly 16.

Hydraulic cylinder 20 is actuated to an extended position to move the gripper assembly 16 in a direction shown as arrow Y in FIG. 5B. The cable 17 and socket 19 are pulled through the gripper assembly 14 in the inoperative state.

Hydraulic cylinder 18 may be dimensioned such that its stroke length is sufficient to move the gripper assembly 14 around the socket 19 so that the socket completely passed through the gripper assembly 14.

FIGS. 6A to 6D show perspective views of the linear winch to provide details on how the gripper assembly 14 reverts to an operative state after passage of the socket through the gripper assembly 14.

Figure 6A:
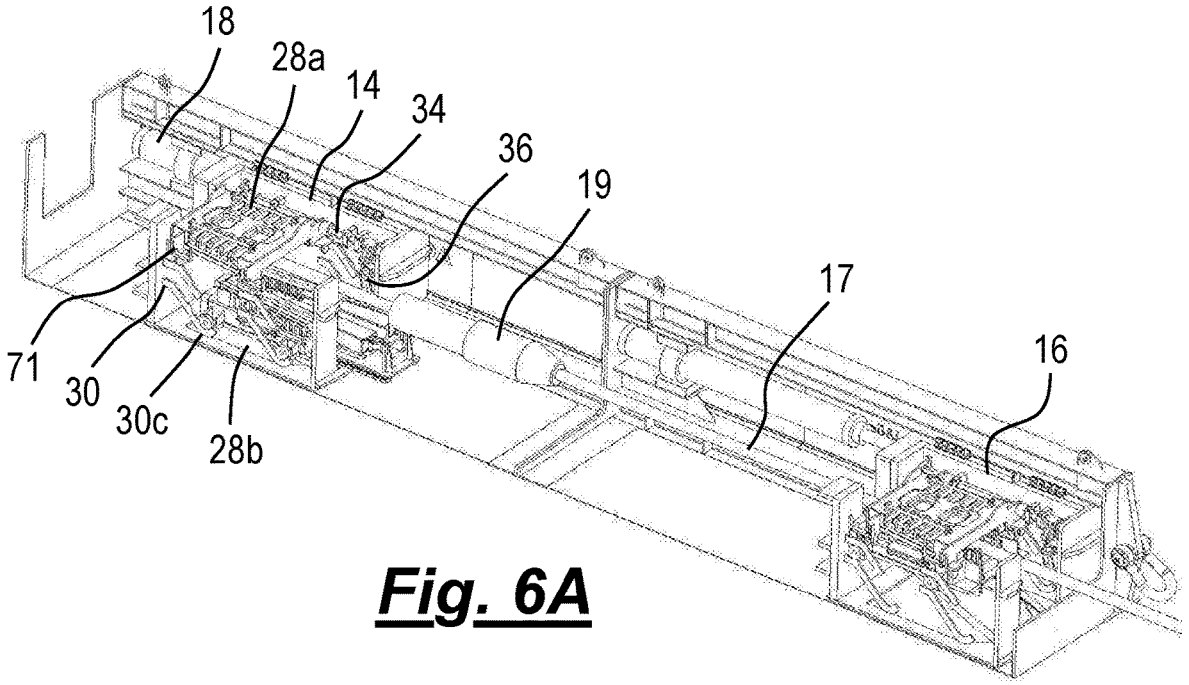
FIGS. 6A to 6D show perspective views of the linear winch to provide details on the gripper assembly 14 reverting to an operative state after passage of the cable connector through the gripper assembly.

FIG. 6A shows the gripper block 28*b* located in an inoperative position where the gripper block 28*b* is located at the third part 30*c* of guide rail 30. Hydraulic cylinder 36 is actuated to a retracted position to rotate the rod 34 and pivot the lid section 28*a* from a generally vertical open position to a generally closed horizontal position. The lid section 28*a* in the closed position is supported by tabs 71 on wall 24*e* of the gripper assembly housing 24. Although in FIG. 6A wall 24*e* is removed for clarity, the location of tabs 71 is shown.

Hydraulic cylinders 32 and 33 are actuated to push the gripper block 28*b* along guide rails 30 from the third part 30*c* along the second part 30*b* to a first part 30*a* which positions the gripper block 28*b* at an operative position which is parallel with the longitudinal axis of in the housing 12 at an elevated position above the base 24*a* of the gripper assembly 14.

As the gripper block 28*b* is moved from an inoperative position to an operative position the gripper slider 44 is located in the cable release position where the gripper slider 44 is located partially outside the gripper block 28*b*. The clamp members 46 are spaced apart from one another to allow the clamp members 46 to be positioned around cable 17 such that the cable 17 is located within the longitudinal semi-cylindrical groove 46*b*.

Figure 6B:
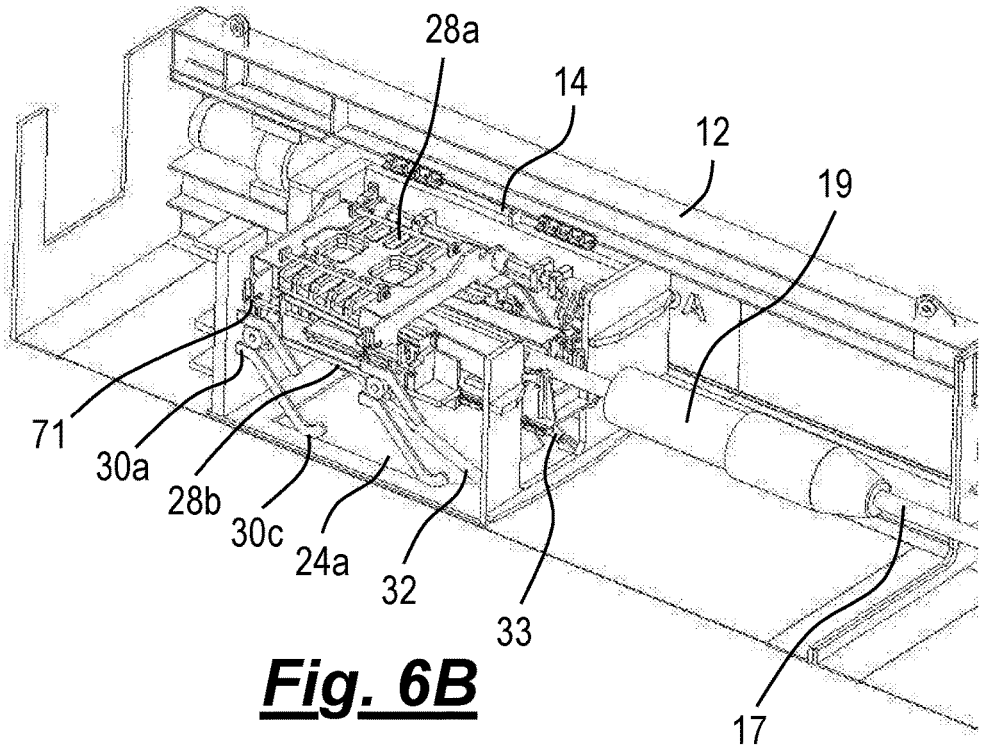
Figure 6C:
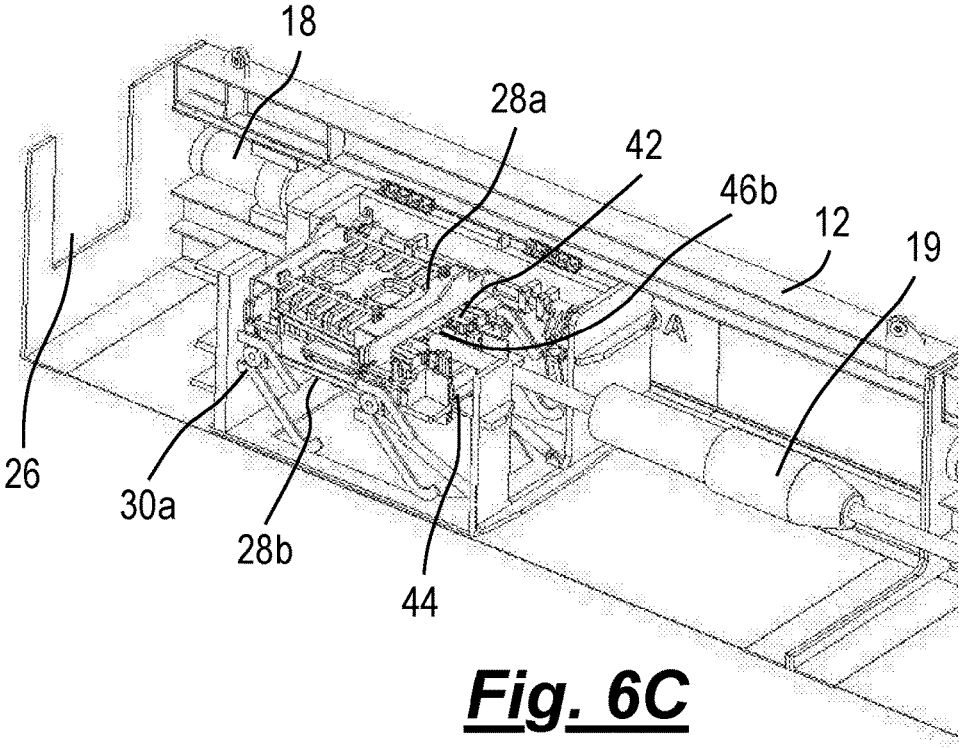

In this operative position shown in FIG. 6B, the upper part of the gripper block 28*b* is surrounded by the lid section. The lid is in an unlocked position.

The hydraulic cylinder 45 is actuated to move the gripper slider 44 from a cable released position to a cable engaged position where the gripper slider 44 is positioned between the bearing members 42 as shown in FIG. 6B. The clamp members are moved toward one another to engage the cable in the longitudinal semi-cylindrical grooves 46*b*.

Figure 6D:
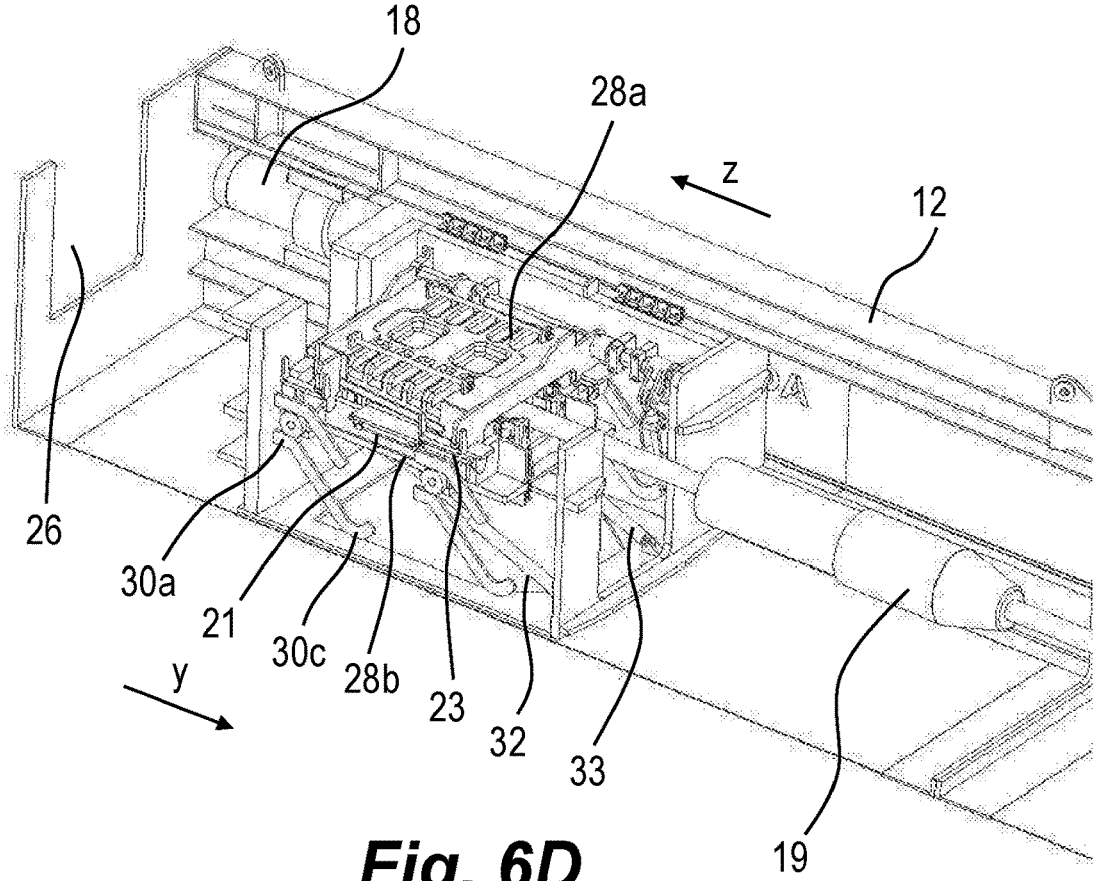

FIG. 6D shows the actuation of hydraulic cylinders 21 and 23 in a general direction Y along the longitudinal axis of the housing 12 to move the lid section 28*a* from an unlocked position to a locked position. In the unlocked position the wedged shape lid section 28*a* is positioned on top of the corresponding wedged shape gripper block 28*b*. The inner surfaces of the wedged shape lid section 28*a* do not bear against the outer surfaces of the wedged shape gripper block 28*b*.

The actuation of hydraulic cylinders 21 and 23 in a general direction Y moves the lid section 28*b* to a locked position such that the inner surfaces of the wedged shape lid section 28*a* bears against the outer surfaces of the wedged shape gripper block 28*b*. In this locked position the lid is clamped onto the gripper block 28*b*. In the locked position the lid provides structural support to the gripper block and may facilitate the gripper block to direct its clamping force to the cable.

FIG. 6D shows the gripper assembly in an operative position where actuation of the hydraulic cylinder 18 to move the gripper assembly 14 in a direction shown by arrow Y results in the gripper assembly 14 gripping the cable and moving the cable in a direction Y. If the hydraulic cylinder 18 moves the gripper assembly 14 in a direction shown by arrow Z the gripper assembly in an operative position direction Y allows the cable to move freely within the gripper assembly.

The gripper assembly 14 is operable to move between an operative position and inoperative position. In the operative position the gripper assembly is configured to grip and release the cable. In the inoperative position the gripper assembly is configured to be moved out of the pathway of the cable socket.

In order to pass the socket 19 through the gripper assembly 14, the gripper block 28*b* releases the cable and moves to an inoperative position to provide a pathway for the socket 19 to pass through the gripper assembly 14. When the gripper assembly 14 is positioned in the inoperative position, the gripper assembly 16 is positioned in an operative position to grip, hold, pull and/or push the cable. The gripper assembly 16 is configured to maintain the tension of the cable when the gripper assembly 14 is positioned in an inoperative position. The gripper assembly 16 is configured to moves the cable along the longitudinal axis of the winch assembly to facilitates the passing of the socket 19 through the gripper assembly 14.

The actions of passing the socket 19 through the gripper assembly 16 are the same as the above described method of passing the socket through the gripper assembly 14. The gripper assembly 14 is maintained in an operative position during the passing of the socket through the gripper assembly 16 to hold, pull and/or push the cable. The gripper assembly 14 is configured to maintain the tension of the cable 17 when the gripper block of the gripper assembly 16 is positioned in an inoperative position to allow the socket to pass. The gripper assembly 14 is configured to move the cable 17 along the longitudinal axis of the winch assembly which facilitates the passing of the socket 19 through the gripper assembly 16.

Although this example describes two gripper assemblies 14 and 16 in the winch to pull the cable 17, additional gripper assemblies may be used in combination to provide additional pulling and/or pushing force when winching heavy loads.

Although this example describes a single hydraulic cylinders connected to each of the gripper assemblies 14 and 16, additional hydraulic cylinders may be connected between the housing 12 and each gripper assembly which may be used in combination with the hydraulic cylinders 18 and 20 to provide additional pulling and/or pushing force when winching heavy loads.

Although, this example shows the lid section 28*a* being pivoted to an open position before the socket is able to pass through the gripper assembly 14, it will be clear that the gripper block 28*b* and the lid section 28*a* may be dimensioned or arranged such that the socket may pass through the gripper assembly when the lid section 28*a* is in a closed position and the gripper block 28*b* is in an inoperative position.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as, "horizontal", "vertical", raise, lower and the like are used herein to indicate directions and locations as they apply to the appended drawings and will not be construed as limiting the invention and features thereof to particular arrangements or orientations.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

The invention provides a linear winch assembly, gripper assembly and a method of use. The linear winch assembly comprises a first gripper assembly comprising a first gripper block operable to grip a cable and a second gripper assembly comprising a second gripper block operable to grip a cable. The winch assembly comprises a first mechanism operable to move at least part of the first gripper block out of the pathway of a cable connector to allow the connector to pass through the first gripper assembly. The winch assembly also comprises a second mechanism operable to move at least part of the second gripper block out of the pathway of a cable connector to allow the connector to pass through the second gripper assembly The sequential passing of the cable connector through each gripper assembly allows the winch assembly to maintain the cable tension. The first gripper assembly may be moved to an inoperative position out of the pathway of the socket while the second assembly maintains the cable tension and applied a pulling force to the cable. The second gripper assembly may subsequently be moved to an inoperative position out of the pathway of the cable connector while the first gripper assembly maintains the cable tension and applied a pulling force to the cable.

The linear winch assembly is able to perform tasks involving pulling in or paying out long cables with cable socket connections. The assembly is capable of passing the cable connector while maintaining cable tension from heavy loads.

Another benefit of the improved gripper assembly is that it may improve the performance of the winch assembly by facilitating the passage of a cable connector quickly and safely through the gripper assembly without having to use a crane or lifting equipment.

Various modifications to the above described embodiments may be made within the scope of the invention herein intended.

The invention claimed is:

1. A gripper assembly for a linear winch assembly comprising:

a lid;

a gripper block movably mounted on at least one guide rail; and a mechanism operable to move the gripper block along the at least one guide rail between an operative position in which the gripper block is configured to sequentially grip and release a cable and an inoperative position which is laterally, vertically and/or horizontally offset from the operative position and is configured to provide a pathway for a connector on the cable through the gripper assembly.

2. The gripper assembly according to claim 1 wherein the lid is movably mounted on the gripper assembly.

3. The gripper assembly according to claim 1 wherein the gripper assembly comprises a guide assembly including the at least one rail, wherein the gripper block is movably mounted on the guide assembly.

4. The gripper assembly according to claim 3 wherein the mechanism is configured to move the gripper block along the guide assembly between the operative position and the inoperative position.

5. A linear winch assembly comprising:

a first gripper assembly comprising a first gripper block; wherein the first gripper block has at least two clamp members;

a second gripper assembly comprising a second gripper block; wherein the second gripper block has at least two clamp members;

wherein the first gripper block is movably mounted on at least one guide rail;

a first mechanism operable to move the first gripper block along the at least one guide rail between an operative position in which the first gripper block is configured to sequentially grip and release a cable and an inoperative position which is laterally, vertical and/or horizontally offset from the operative position and is configured to provide a pathway for a connector on the cable through the first gripper assembly; and a second mechanism operable to move at least part of the second gripper block between an operative position in which the second gripper block is configured to sequentially grip and release a cable and an inoperative position which is laterally, vertical and/or horizontally offset from the operative position and is configured to provide a pathway for a connector on the cable through the second gripper assembly.

6. The linear winch assembly according to claim 5, wherein the inoperative position is within a linear winch housing.

7. The linear winch assembly according to claim 5, wherein the inoperative position is within a linear winch assembly housing.

8. The linear winch assembly according to claim 5 wherein the first gripper assembly and/or the second gripper assembly are configured to move within the linear winch assembly to pull and/or push a cable.

9. The linear winch assembly according to claim 5 wherein the first gripper block and the second gripper block are configured to sequentially move out of the pathway of the cable connector.

10. The linear winch assembly according to claim 5 wherein the first mechanism and/or second mechanism comprise a hydraulic, pneumatic, electric or mechanical actuator.

11. The linear winch assembly according to claim 5 wherein the first gripper assembly comprises a first lid and the second gripper assembly comprises a second lid.

12. The linear winch assembly according to claim 11 wherein the first gripper assembly comprises a mechanism configured to open and close the first lid and the second gripper assembly comprises a mechanism configured to open and close the second lid.

13. The linear winch assembly according to claim 5 comprising a control unit wherein the control unit is configured to control the position of the first and/or second gripper assemblies to enable controlled passing of the cable connector through the winch assembly.

14. A method of operating a linear winch assembly, the method comprising:

providing a linear winch assembly comprising:

a first gripper assembly comprising a lid and a gripper block;

at least one guide rail on which the gripper block is movably mounted; and a mechanism operable to move the gripper block along the at least one guide rail between an operative position in which the first gripper block is configured to sequentially grip and release a cable and an inoperative position which is laterally, vertically and/or horizontally offset from the operative position;

moving the gripper block along the at least one guide rail out to the inoperative position;

and passing the cable connector through the gripper assembly.

15. The method as claimed in claim 14 comprising moving the first gripper assembly to pass the cable connector through the first gripper assembly.

16. The method as claimed in claim 14 comprising moving the at least part of the first gripper block from the inoperative position to the operative position when the cable connector has passed through the through the first gripper assembly.

17. The method as claimed in claim 14 comprising:

providing a second gripper assembly comprising:

a second lid;

a second gripper block; and a second mechanism operable to move the second gripper block between an operative position in which the second gripper block is configured to sequentially grip and release a cable and an inoperative position which is vertically and/or horizontally offset from the operative position;

moving the second gripper block along the at least one guide rail to the inoperative position; and passing the cable connector through the second gripper assembly.

18. The method as claimed in claim 17 comprising moving the first and/or the second gripper block laterally, vertically and/or horizontally out of the pathway of a cable connector.

19. The method as claimed in claim 17 comprising moving the second gripper block from the inoperative position to the operative position when the cable connector has passed through the second gripper assembly.

20. The method as claimed in claim 17 comprising moving the first and/or second gripper assembly to pull in or pay out a cable.

21. The method as claimed in claim 17 comprising moving the second gripper assembly to push and/or pull the cable to move the cable connector through the first gripper assembly.

22. The method as claimed in claim 17 comprising moving the first gripper assembly to push and/or pull the cable to move the cable connector through the second gripper assembly.

23. The method as claimed in claim 17 comprising moving the first gripper assembly to move the cable connector through the first gripper assembly and/or moving the second gripper assembly to pass the cable connector through the second gripper assembly.

* * * * *